US006536568B1

(12) United States Patent
Tong

(10) Patent No.: US 6,536,568 B1
(45) Date of Patent: Mar. 25, 2003

(54) SUITCASE WITH BUILT-IN SAFETY STRAP

(76) Inventor: Joy Tong, 2932 NW. 27th St. Bldg. 14, Ft. Lauderdale, FL (US) 33311

( * ) Notice: Subject to any disclaimer, the term of this patent is extended or adjusted under 35 U.S.C. 154(b) by 0 days.

(21) Appl. No.: 10/092,429

(22) Filed: Mar. 8, 2002

(51) Int. Cl.[7] ..... A45C 13/18
(52) U.S. Cl. ..... 190/101; 190/102; 280/37
(58) Field of Search ..... 190/101, 108, 190/102, 115, 18 R, 18 A; 280/37; 224/580; 16/113.1, 114.1

(56) References Cited

U.S. PATENT DOCUMENTS 4,759,431 A * 7/1988 King et al. ..... 178/30
5,330,141 A * 7/1994 Kim ..... 248/98
5,355,980 A * 10/1994 Hsieh ..... 190/115
5,431,262 A * 7/1995 Rekuc et al. ..... 190/18 A
5,560,458 A * 10/1996 Franklin et al. ..... 182/153
5,593,009 A * 1/1997 King ..... 190/102
5,645,146 A * 7/1997 Bieber et al. ..... 190/18 A
5,762,169 A * 6/1998 Deliman et al. ..... 190/101
5,875,876 A * 3/1999 Wang ..... 190/18 A
5,927,450 A * 7/1999 Sadow ..... 190/102
6,325,189 B1 * 12/2001 King et al. ..... 190/119
2002/0145018 A1 * 10/2002 Godshaw et al.

* cited by examiner

*Primary Examiner*—Lee Young
*Assistant Examiner*—Lien Ngo
(74) *Attorney, Agent, or Firm*—Bacon & Thomas, PLLC

(57) ABSTRACT

A suitcase with a built-in safety strap with the suitcase made of soft material having an opening provided to its inner side, an interior pocket in the opening, and the safety strap having a male mobile buckle provided at its front end being sewn in the interior pocket for the safety strap to be pulled out to fasten the suitcase and to prevent accidental bust of a zipper of the suitcase.

9 Claims, 7 Drawing Sheets

SUITCASE WITH BUILT-IN SAFETY STRAP

BACKGROUND OF THE INVENTION (a) Field of the Invention

The present invention is related to a suitcase with built-in safety strap, and more particularly to one made of canvas or fabric-like soft material with a built-in safety strap which to be pulled out to fasten the suitcase for securing the suitcase and prevent accidental bust of the zipper.

(b) Description of the Prior Art

There are many styles of suitcase generally available in the market. Some are made of plastic material, while others, soft materials such as canvas or fabric like materials. For the latter, a multiple of roller caster is usually provided at the bottom with a retractable frame extending upward is embedded to the inner side of the suitcase for carrying purpose. An opening sewn with a zipper is provided to the peripheral of the suitcase to open or zip up the suitcase as applicable.

However, whenever the suitcase is overloaded, the zipper could get easily busted up. When one is on overseas trip, it is not uncommon that the suitcase is overstuffed. Consequently, one will use an extra strap to fasten up the suitcase before boarding the airplane. The shame is that such extra strap is not necessarily available in a hustling airport, so one is forced to board the airplane worrying about losing the contents in the suitcase due to accidental bust of the zipper.

SUMMARY OF THE INVENTION

The primary purpose of the present invention is to provide a suitcase with a built-in safety strap. To achieve the purpose, the suitcase is made of canvas or fabric-like soft material. A retractable frame is embedded to the inner side of the suitcase to carry the suitcase. An interior bag is provided at a selected location in the middle of the retractable frame for the safety strap provided with a male mobile buckle to be sewn therein to form a suitcase with a built-in safety strap. The safety strap is pulled out to fasten the suitcase with the male mobile buckle at its front end to be engaged with a female mobile buckle provided on the top of the suitcase to prevent accident bust of the zipper.

Another purpose of the present invention is to provide a suitcase with a built-in safety strap. Wherein, an opening is provided at where close to the middle of a retractable frame, a mobile flap is sewn to where above the opening, and a zipper is respectively sewn to the mobile flap and the circumference of the opening. Both of said mobile flap and the opening are zipped up to conceal a built-in interior pocket and the safety strap in the suitcase.

Another purpose yet of the present invention is to provide a suitcase with a built-in safety strap, wherein, a mobile buckling means is provided on the top end of the interior pocket for other strap to lock up for storage.

DETAILED DESCRIPTION OF THE PREFERRED EMBODIMENTS

Figure 1:
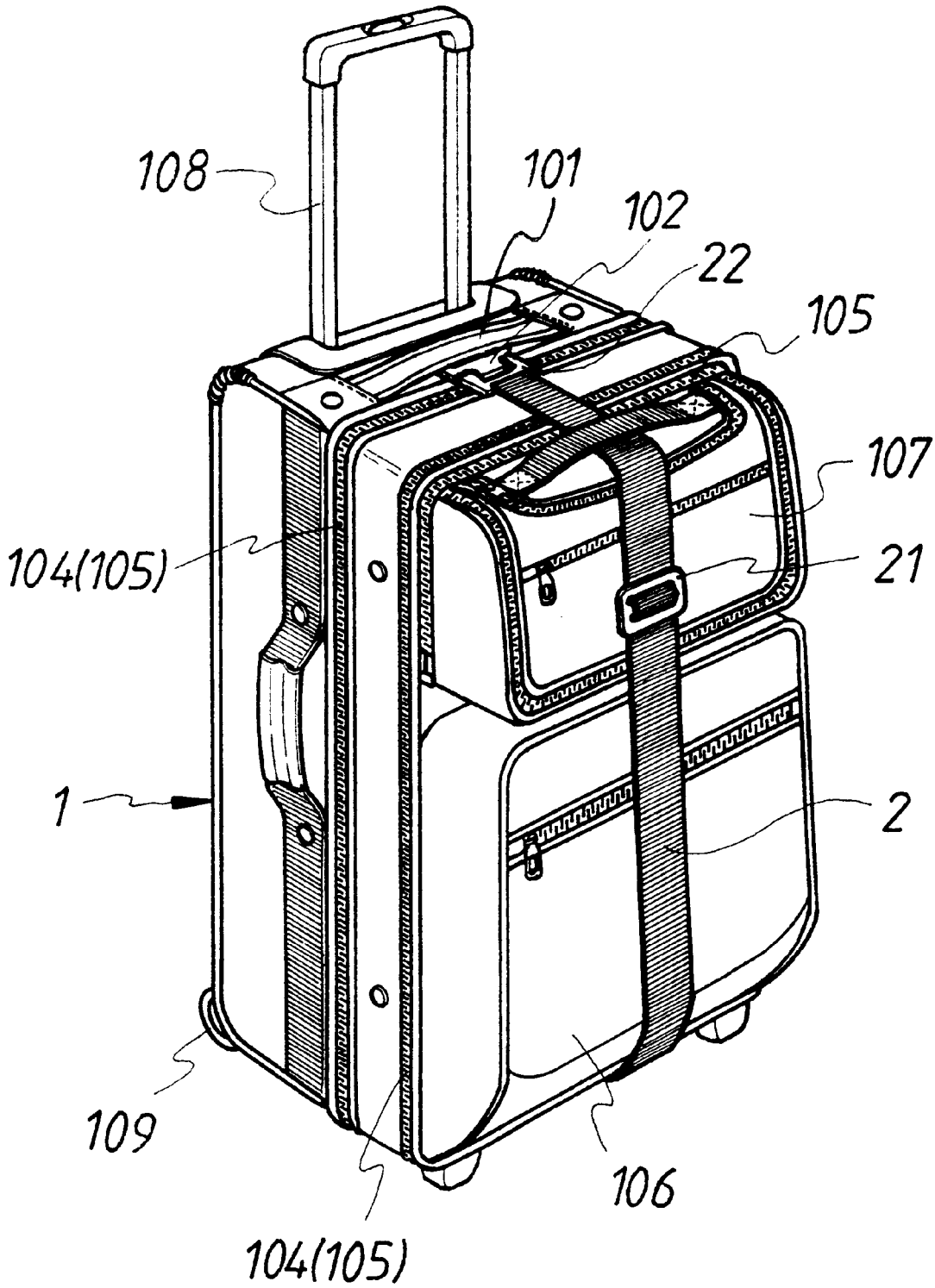
FIG. 1 is a front view of the present invention in use.
Figure 2:
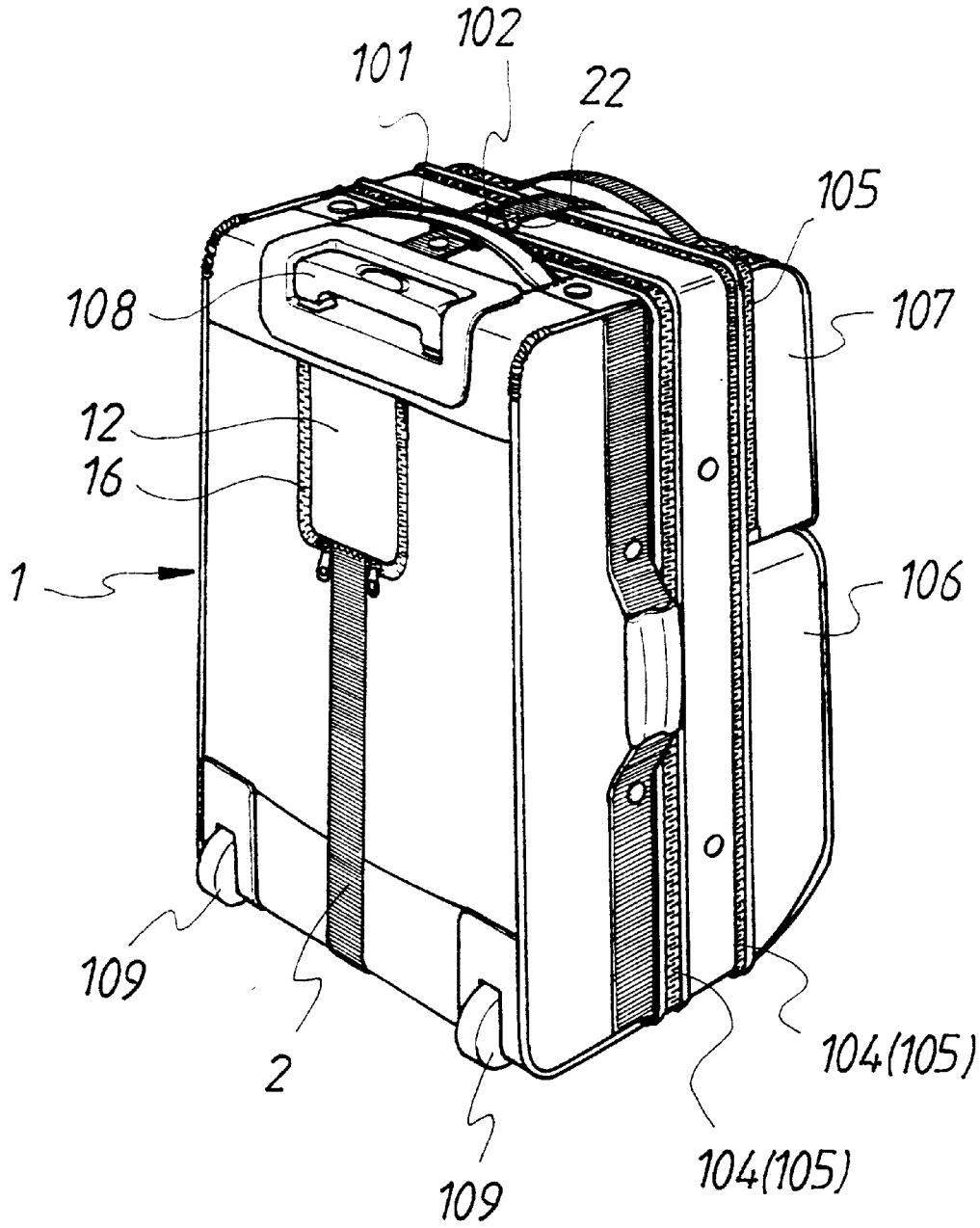
FIG. 2 is a rear view of the present invention is use.
Figure 3:
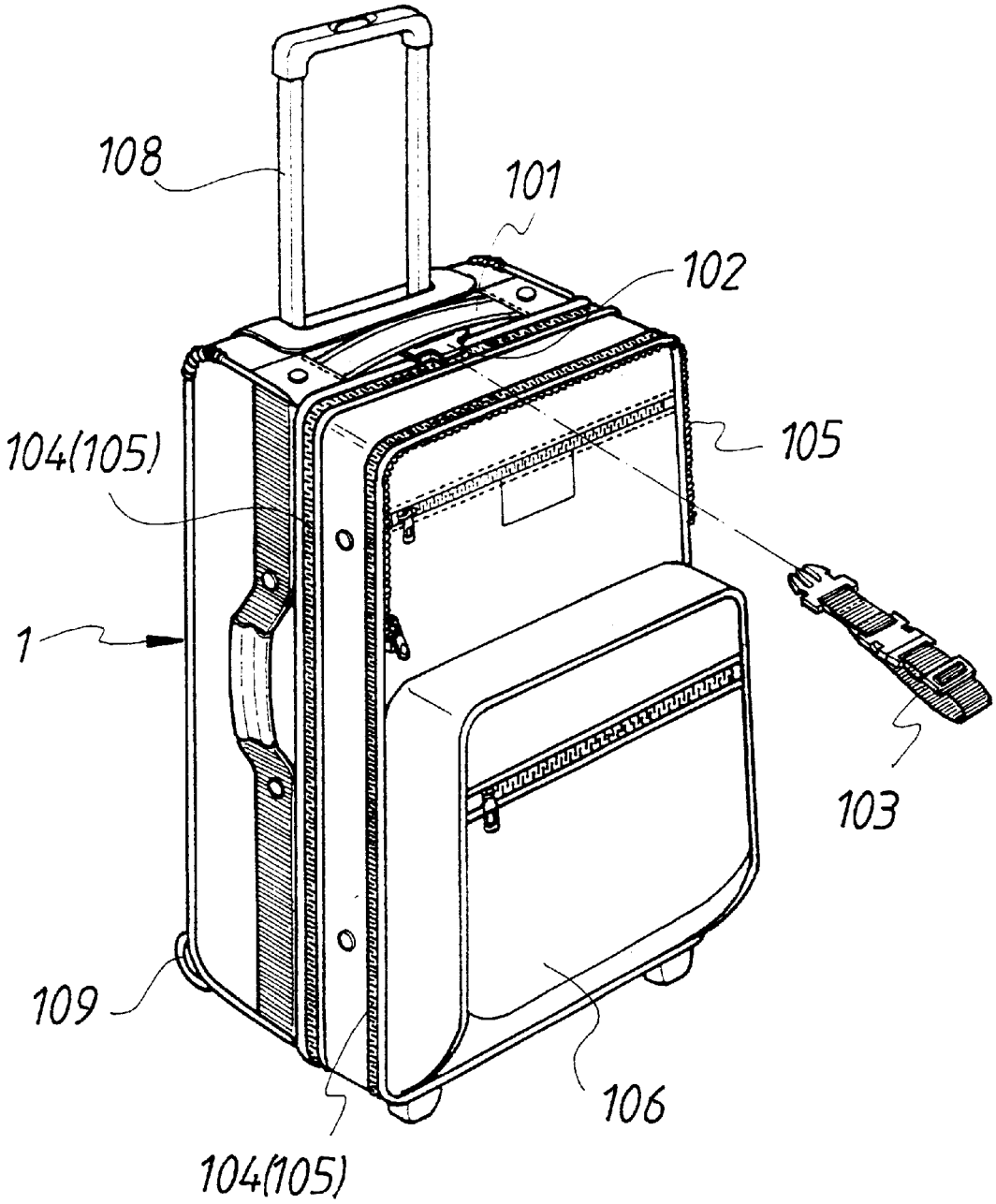
FIG. 3 is a front view of a suitcase of the present invention.

Referring to FIGS. 1 and 2, a preferred embodiment of the present invention is comprised of a suitcase 1 and a safety strap 2. Within, also as illustrated in FIG. 3, the suitcase 1 is made of canvas or fabric-like soft material. a handle 101 is provided at the top of the suitcase 1, a female mobile buckle 102 of the conventional type is fixed to the suitcase 1 at where below the handle 101. A conventional suspension belt 103 is provided to the buckle 102 while one or more than one opening 104 is provided along the peripheral of the suitcase 1. An exterior pocket 106 is provided in the lower portion of the front of the suitcase land a single side of zipper 105 is sewn to three sides of the suitcase 1 above the exterior bag 106 to adapt to an additional pocket 107 as required. A ⊓shape retractable frame 108 is vertically embedded at where in the middle inside the suitcase 1 to be adapted to four roller casters 109 provided at the bottom of the suitcase 1 to facilitate carrying the suitcase 1.

Figure 4:
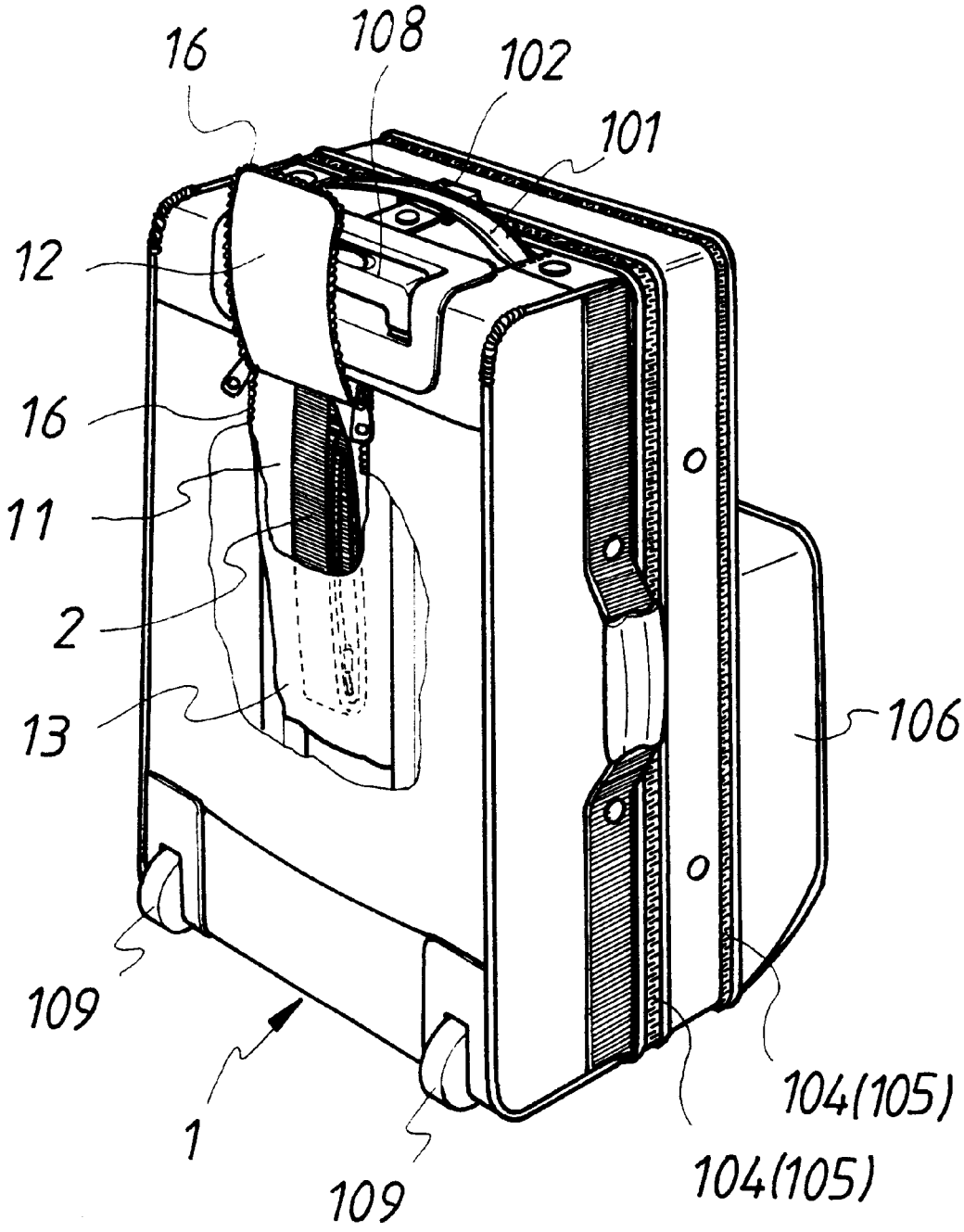
FIG. 4 is a perspective view of the rear of the suitcase and an interior pocket of the present invention.
Figure 5:
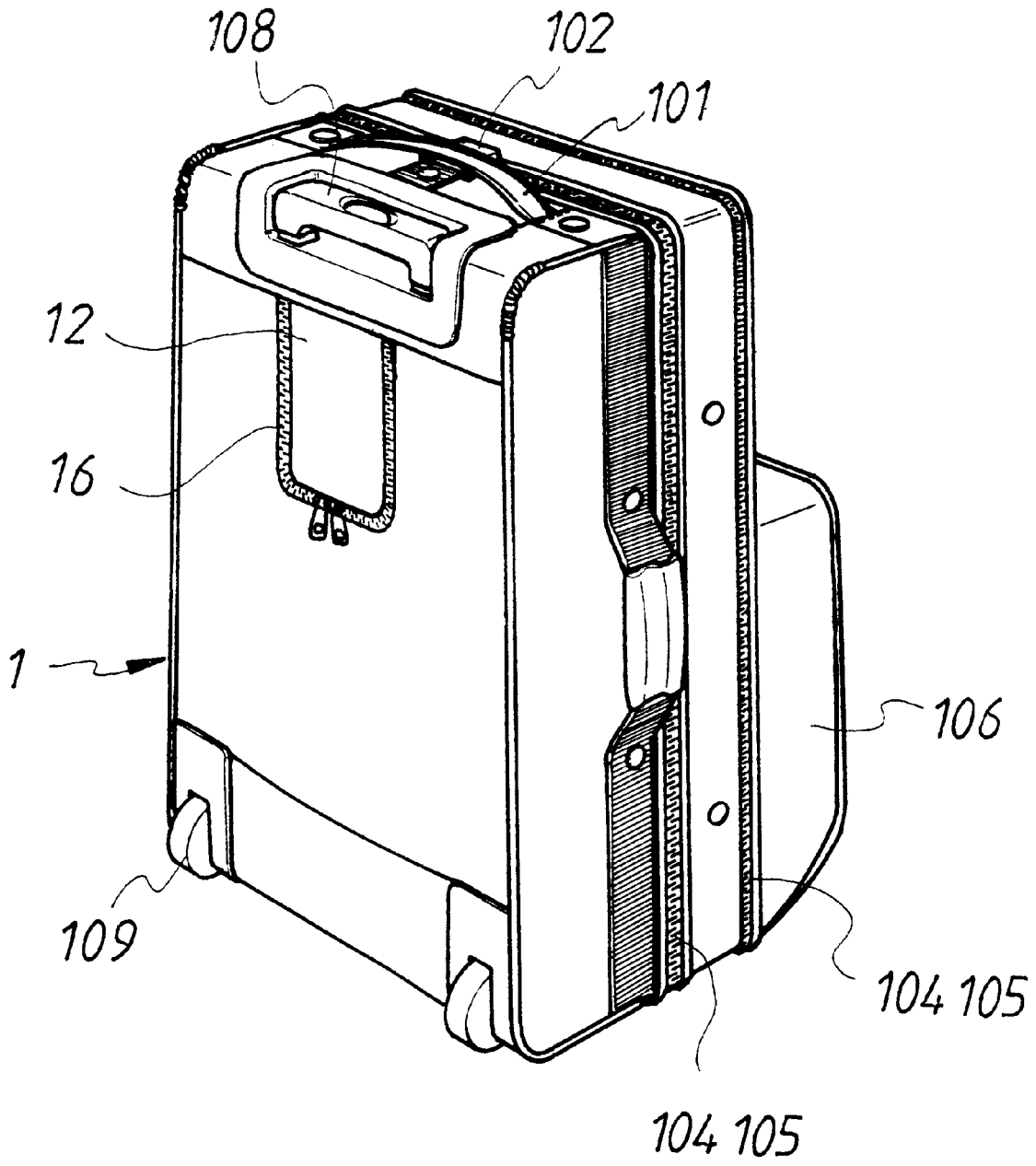
FIG. 5 is a schematic view of a mobile flap in its closed status of the present invention.
Figure 6:
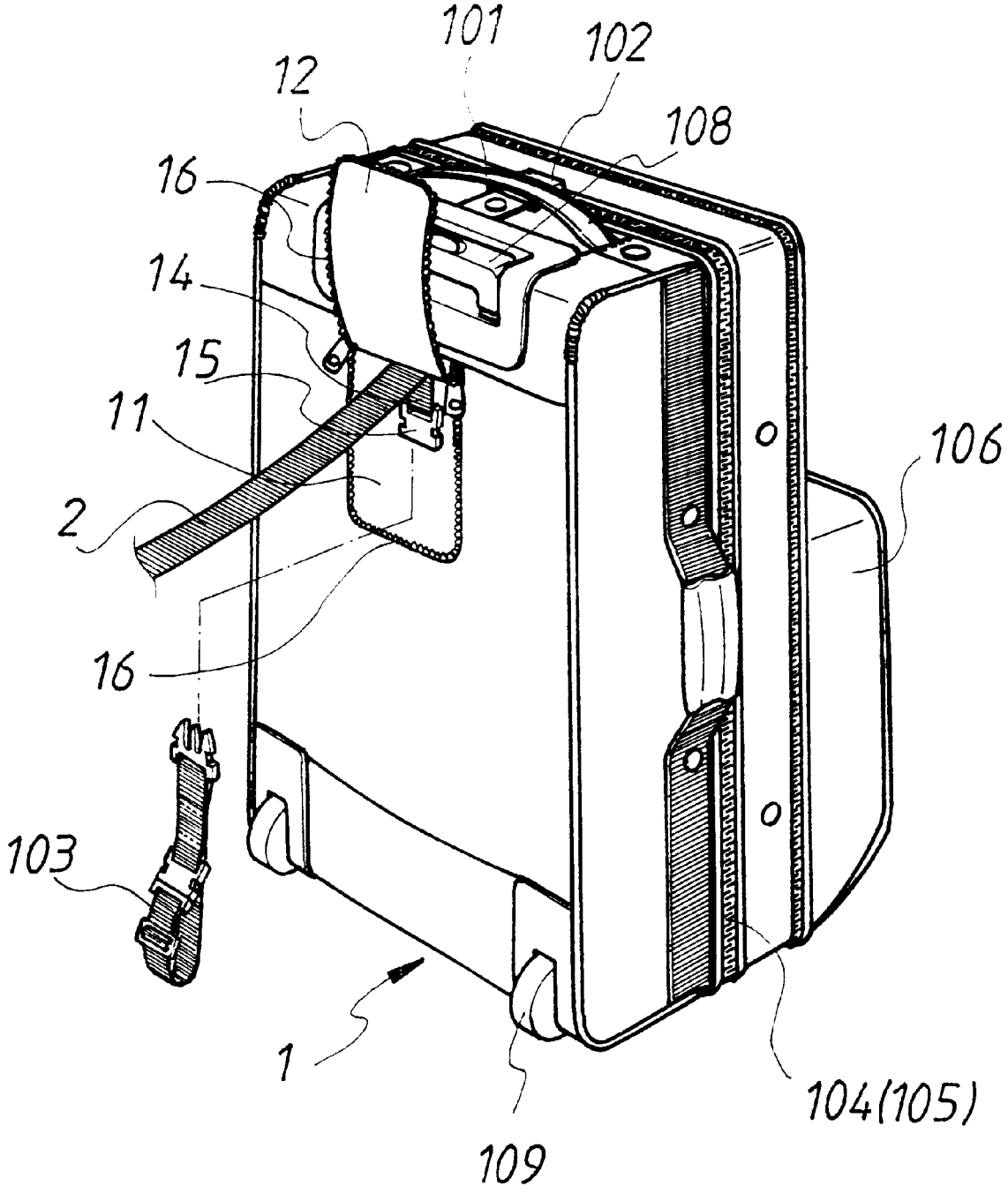
FIG. 6 is a schematic view of the mobile flap in its opened status of the present invention.

As illustrated in FIGS. 4 and 6, a rectangular opening 11 provided in the middle inside the suitcase 1 that communicates with the retractable frame 108 at its middle. A mobile flap 12 is provided above the opening 11; or alternatively, said flap 12 can be directly formed in the course of cutting the opening or separately sewn to the opening 11. A single side of a zipper 16 is respectively sewn to the opening 11 and the edge of the mobile flap 12 so to leave open the opening 11 or to zip up the opening 11 as illustrated in FIG. 5. An interior pocket 13 is fixed at the upper end inside the opening 11 for the interior pocket 13 to be concealed in the suitcase 1 and vertically disposed in the middle of the retractable frame 108. A woven band 14 is provided to the upper end of the interior pocket 13 and a female mobile buckle 15 is provided to the lower end of the woven band 14 so that the suspension belt 103 can be removed and buckled to the interior pocket 13 for storage as illustrated in FIG. 6.

The safety strap 2 as illustrated in FIGS. 1 and 2 relates to a woven band generally available in the market. An adjustment ring 21 in approximately "8" shape inserted in the middle section of the band. The front end of the band penetrates through a male mobile buckle 22 and further into the adjustment ring 21 to form a a safety strap 2 having at its front end a male mobile buckle 22 and allowing free adjustment of its length.

As illustrated in FIG. 6, the rear end of the safety strap 2 is sewn to the upper end of the interior pocket 13 so that the safety strap 2 is allowed to extend outside the suitcase 1 or folded into the interior pocket 13 as illustrated in FIG. 4. As a result, the built-in safety strap 2 while fastening the suitcase 1 prevents accidental bust of the zipper.

Figure 7:
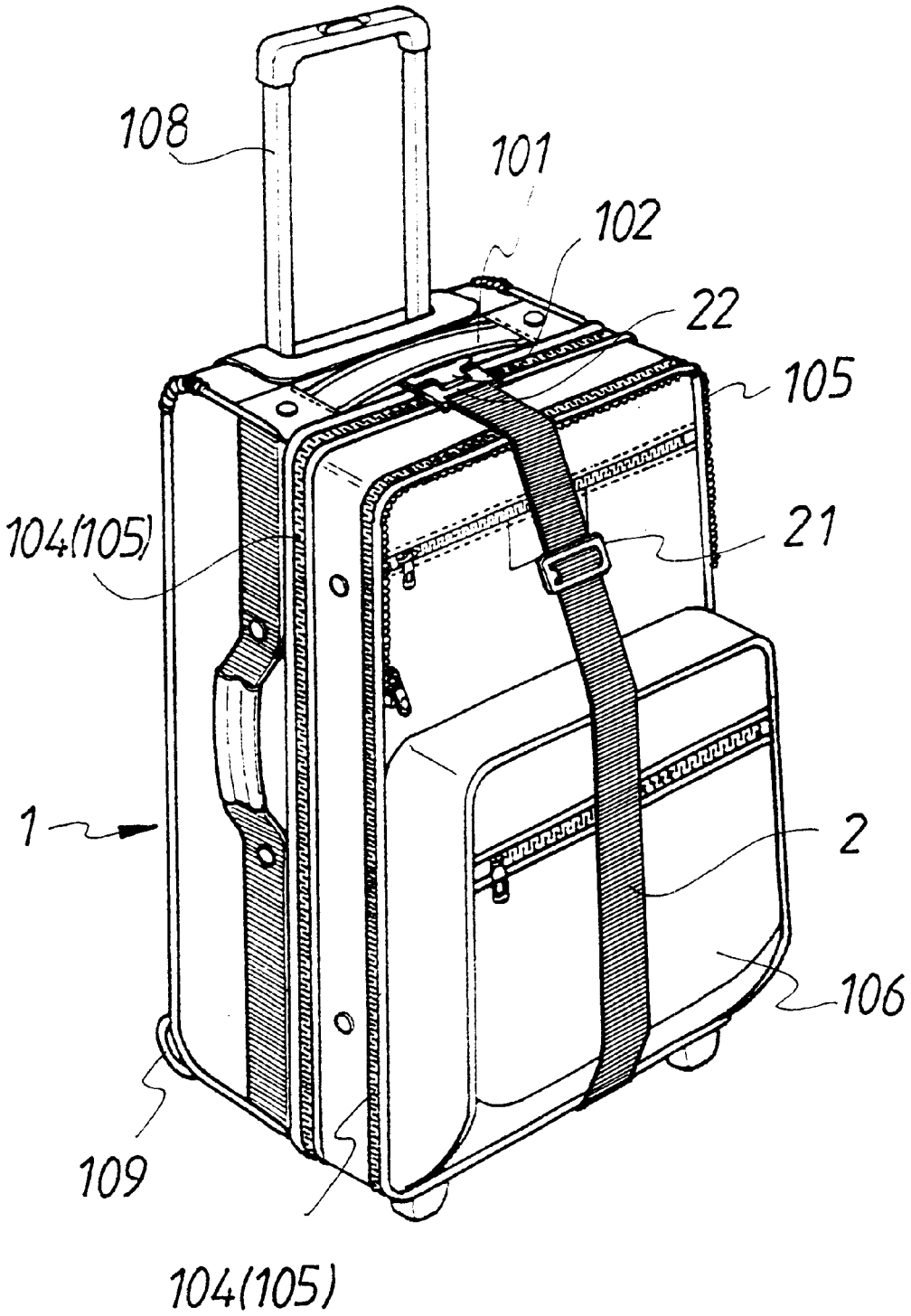
FIG. 7 is a perspective view of the present invention with the absence of an additional bag.

Now referring to FIGS. 1, 2 and 7, in practice, the suspension band 103 provided at the upper end of the suitcase is removed and buckled inside the interior pocket 13 for storage while the safety strap 2 otherwise inside the interior pocket 13 is pulled out and circumventing the bottom of the suitcase 1 to its front side and upper end. The male mobile buckle 22 at the front end of the safety strap 2 is engaged with the female mobile buckle 102 provided at the upper end of the suitcase 1 to fasten up the suitcase 1 to prevent accidental bust of the zipper 105 during handling of the suitcase 1 or in case that the suitcase 1 is overloaded. The safety strap 2 can be easily accessed or stored since it is built in the middle section of the retractable frame 108 provided to the inner side of the suitcase, so that the carrier won't have to worry about finding a strap when required. Furthermore, if an additional pocket 107 is attached to the suitcase 1, it can be also fastened by the safety strap at the same time. When the suitcase 1 contains only a very few items, its volume can be reduced by means of the adjustment ring 21 to shorten the length of the safety strap.

It is to be noted that the configuration of the suitcase disclosed above is for convenience of the preferred embodiment of the present invention and in no way confines other configurations of the suitcase which shall be included in the scope of the teaching and pending patent of this application.

What is claimed is:

1. A suitcase with a built-in safety strap is essentially comprised of a suitcase and a safety strap, the suitcase being made of soft material; a female mobile buckle being provided at the upper end of the suitcase; a retractable frame being vertically embedded in the inner side of the suitcase for carrying in conjunction with a multiple of roller caster provided at the bottom of the suitcase, an opening being provided to the inner side of the suitcase that is communicating to the middle of the retractable frame, an interior pocket being provided inside the opening; and the safety strap comprising a woven band having a male mobile buckle at a front end of a strap characterized by that a rear end of the safety strap is fixed in the interior pocket in the opening to the inner side of the suitcase to be pulled out when required such that the male mobile buckle can be connected to the female mobile buckle or to be stored inside the interior pocket when not used.

2. A suitcase with a built-in safety strap as claimed in claim 1, wherein, the upper end of the interior pocket is sewn to the upper end in the opening to merely drop in the middle of the retractable frame.

3. A suitcase with a built-in safety strap as claimed in claim 1, wherein, the length of the safety strap is adjustable achieved by means of an adjustment ring being inserted through the safety strap at its middle section with the front end of the safety strap passing through the male mobile buckle and then through the adjustment ring.

4. A suitcase with a built-in safety strap as claimed in claim 2, wherein, the adjustment ring indicates an approximate 8 shape.

5. A suitcase with a built-in safety strap as claimed in claim 1, wherein, the rear end of the safety strap is sewn to the upper end of the interior pocket.

6. A suitcase with a built-in safety strap as claimed in claim 1, wherein, another woven band is provided to the upper end of the interior pocket and a female mobile buckle is provided at the lower end of the woven band for the storage of other straps.

7. A suitcase with a built-in safety strap as claimed in claim 1, wherein, the suitcase comprises a rectangular opening provided with a mobile flap at the top of the opening, and a single side of a zipper is provided along the edges of the opening and the mobile flap to open or close the opening as applicable.

8. A suitcase with a built-in safety strap as claimed in claim 1, wherein, a handle is provided on the top of the suitcase and the female buckle is fixed at where below the handle.

9. A suitcase with a built-in safety strap as claimed in claim 1, wherein, an detachable outer pocket is separately provided in the lower of the front of the suitcase with its three sides sewn with a single side of a zipper.

* * * * *